US008355236B2

(12) United States Patent
Yuba et al.

(10) Patent No.: US 8,355,236 B2
(45) **Date of Patent: *Jan. 15, 2013**

(54) CONNECTOR AND POWER SUPPLY UNIT WITH SAFETY MECHANISM

(75) Inventors: Takashi Yuba, Shinagawa (JP); Koichi Kiryu, Shimotakai-gun (JP); Keiichi Hirose, Minato-ku (JP); Tomonori Iino, Minato-ku (JP)

(73) Assignees: Fujitsu Component Limited, Tokyo (JP); NTT Facilities, Inc., Tokyo (JP)

( * ) Notice: Subject to any disclaimer, the term of this patent is extended or adjusted under 35 U.S.C. 154(b) by 377 days.

This patent is subject to a terminal disclaimer.

(21) Appl. No.: 12/760,253

(22) Filed: Apr. 14, 2010

(65) Prior Publication Data

US 2011/0256747 A1 Oct. 20, 2011

(51) Int. Cl.
*H01H 47/00* (2006.01)

(52) U.S. Cl. ..... 361/160

(58) Field of Classification Search ..... 361/160
See application file for complete search history.

(56) References Cited

U.S. PATENT DOCUMENTS 7,938,660 B1 * 5/2011 Beak et al. ..... 439/269.1
7,982,145 B2 * 7/2011 Yuba et al. ..... 200/51 R

FOREIGN PATENT DOCUMENTS

| | | |
|---|---|---|
| JP | 62-116380 | 7/1987 |
| JP | 05-82208 | 4/1993 |
| JP | 6-009076 | 2/1994 |
| JP | 2003-31301 | 1/2003 |

OTHER PUBLICATIONS

Office Action Dated Sep. 18, 2012 issued to the respect of basic Japanese Patent Application 2008-288800.

* cited by examiner

*Primary Examiner* — Stephen W Jackson
(74) *Attorney, Agent, or Firm* — IPUSA, PLLC

(57) ABSTRACT

A female connector for supplying electric power from a power supply to an electric device includes two power supply terminals to supply the electric power, two relays connected to the two power supply terminals, respectively, to control supply of the electric power, and two control electrodes configured to control opening and, closing of the two relays, wherein the two relays are driven by the power supply, and the two control electrodes are electrically coupled to each other through a control terminal of a male connector upon mating between the female connector and the male connector, the electrical coupling of the two control electrodes causing the two relays to be closed to supply the electric power to the two power supply terminals.

6 Claims, 5 Drawing Sheets

CONNECTOR AND POWER SUPPLY UNIT WITH SAFETY MECHANISM

BACKGROUND OF THE INVENTION

1. Field of the Invention

The disclosures herein generally relate to a connector and power supply unit used for the purpose of supplying electric power.

2. Description of the Related Art

Electric equipment generally receives electric power from a power supply to operate. For the purpose of supplying electric power, connectors are typically used to supply electric power from the power supply to electric equipment. Such connectors include a male-type connector having one or more male pins and a female-type connector having one or more female sockets, which mate with each other to establish electrical connection. This configuration is disclosed in Patent Documents 1 and 2.

In recent years, the supply of direct-current high-voltage electric power for local-area electric power transmission has been under study as a measure against global warming. With such a power supply arrangement, power loss is small at the time of voltage conversion and electric power transmission, and, also, there is no need to use thick cables. Especially for information devices such as servers, such a power supply arrangement is believed to be desirable due to their large consumption of electric power.

Caution should be taken for the electric power that is supplied to electric equipment because direct contact by a human body is hazardous. In particular, a direct-current electric power has no frequency dependency, which may require greater caution.

Manual work is performed for the installment and maintenance of equipment. When direct-current electric power is used for information devices such as servers, thus, connectors used at the point of electrical connection may need to have a special design that is different from that of normal connectors used for commercial power supply.

Further, a power supply unit having a plurality of connectors is typically used to supply electric power to loads, e.g., information devices such as servers.

[Patent Document 1] Japanese Patent Application Publication No. 5-82208

[Patent Document 2] Japanese Patent Application Publication No. 2003-31301

SUMMARY OF THE INVENTION

It is a general object of the present invention to provide a connector and a power supply unit that substantially eliminate one or more problems caused by the limitations and disadvantages of the related art. Specifically, it may be desirable to provide a connector and power supply unit that can safely supply electric power.

According to an embodiment, a female connector for supplying electric power from a power supply to an electric device includes two power supply terminals to supply the electric power, two relays connected to the two power supply terminals, respectively, to control supply of the electric power, and two control electrodes configured to control opening and closing of the two relays, wherein the two relays are driven by the power supply, and the two control electrodes are electrically coupled to each other through a control terminal of a male connector upon mating between the female connector and the male connector, the electrical coupling of the two control electrodes causing the two relays to be closed to supply the electric power to the two power supply terminals.

According to an embodiment, a power supply unit comprising a plurality of connectors, at least one of which is the female connector as set forth above.

A pair of connectors includes a male connector including a control pin and power pins to receive electric power, and further includes a female connector. The female connector includes two power supply sockets configured to mate with the power pins to supply the electric power to the power pins, two relays connected to the two power supply sockets, respectively, to control supply of the electric power, a control socket configured to mate with the control pin, two control electrodes situated in the control socket to control opening and closing of the two relays, wherein the two control electrodes are electrically coupled to each other through the control pin upon mating between the female connector and the male connector, the electrical coupling of the two control electrodes causing the two relays to be closed to supply the electric power to the two power supply sockets.

According to at least one embodiment, a connector and power supply unit that can safely supply electric power are provided.

BRIEF DESCRIPTION OF THE DRAWINGS

Other objects and further features of the present invention will be apparent from the following detailed description when read in conjunction with the accompanying drawings, in which.

DESCRIPTION OF THE PREFERRED EMBODIMENTS

In the following, embodiments of the present invention will be described with reference to the accompanying drawings.

[Outline of Connector]

Figure 1:
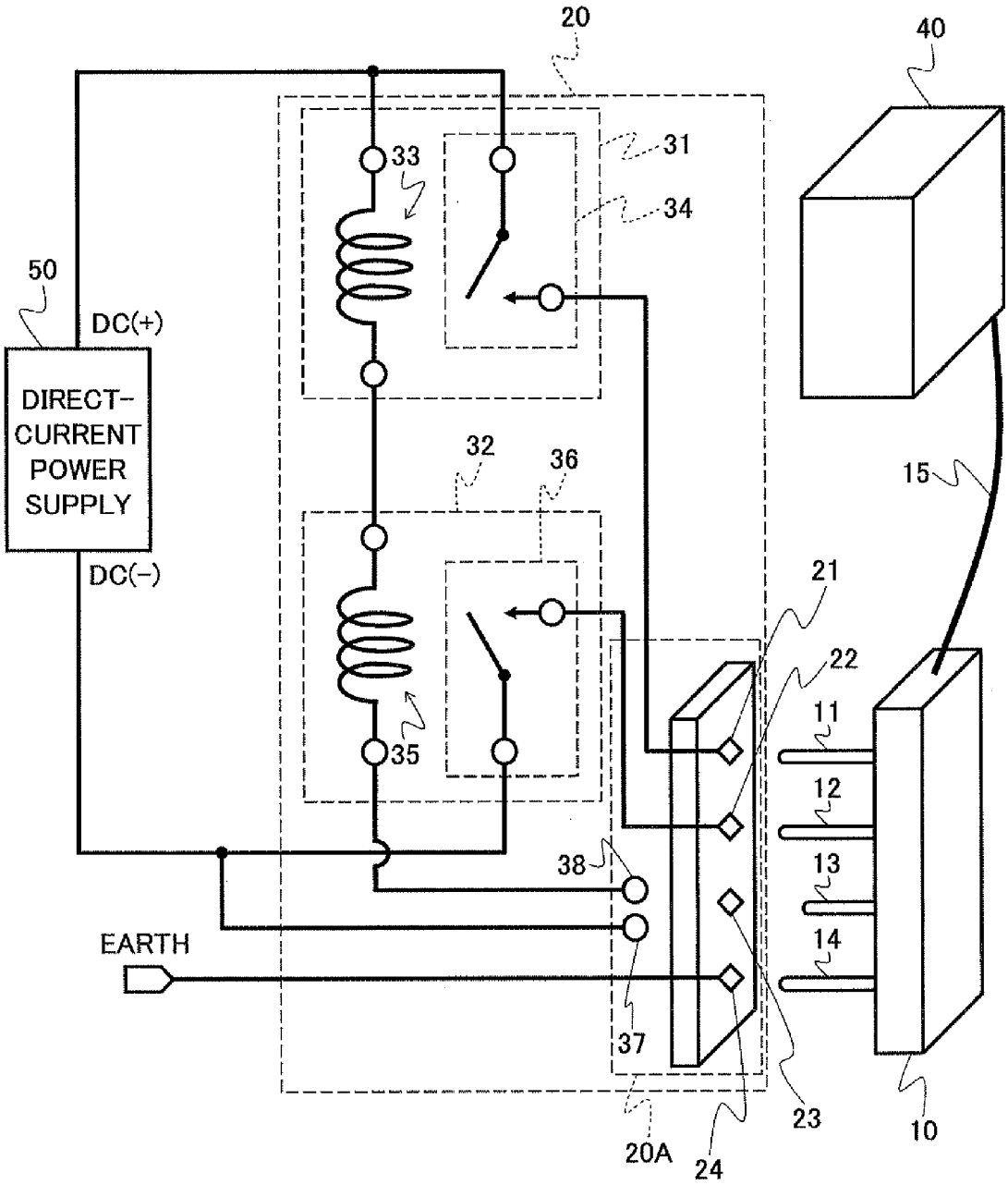
FIG. 1 is a drawing illustrating the configuration of a connector according to an embodiment.

In the following, a connector according to an embodiment will be described. FIG. 1 is a drawing illustrating an outline of the configuration of a female connector according to the present embodiment.

A female connector 20 according to the present embodiment is coupled to a direct-current power supply 50 for supplying electric power. The female connector 20 includes power-supply jack terminals 21 and 22 for supplying electric power, a control jack terminal 23, and a ground jack terminal 24 connected to the earth. Electrodes 37 and 38 are provided inside the control jack terminal 23.

A male connector 10 that is to be connected to the female connector 20 according to the present embodiment is coupled to an information device 40 such as a server through a power supply cable 15. The male connector 10 includes power supply plug terminals 11 and 12 to mate with the power-supply jack terminals 21 and 22, a control plug terminal 13 to mate with the control jack terminal 23, and a ground plug 14 to mate with the ground jack terminal 24.

Two relays 31 and 32 are provided in the female connector 20. The relay 31 includes a coil 33 and a relay contact 34 that is closed to provide electrical connection in response to an electrical current running through the coil 33. The relay contact 34 is placed in an open state to provide no electrical connection when no electric current flows through the coil 33. The relay 32 includes a coil 35 and a relay contact 36 that is closed to provide electrical connection in response to an electrical current running through the coil 35. The relay contact 36 is placed in an open state to provide no electrical connection when no electric current flows through the coil 35.

One end of the relay contact 34 is connected to a positive output of the direct-current power supply 50, and the other end thereof is connected to the power-supply jack terminal 21. One end of the relay contact 36 is connected to a negative output of the direct-current power supply 50, and the other end thereof is connected to the power-supply jack terminal 22.

In order to drive the relays 31 and 32, the female connector 20 receives the direct-current power supply 50 that is the same as the power supply for supplying electric power through the connectors. To be specific, one end of the coil 33 of the relay 31 is connected to one end of the coil 35 of the relay 32. With this arrangement, the coil 33 of the relay 31 and the coil 35 of the relay 32 are connected in series (i.e., series-connected). The other end of the coil 33 is connected to one end of the direct-current power supply 50. The other end of the coil 35 and the other end of the direct-current power supply 50 are connected to the two electrodes 38 and 37, respectively, which are situated inside the control jack terminal 23.

In this manner, the direct-current power supply 50 is used as the power supply to drive the relays 31 and 32. This arrangement eliminates the need to provide a dedicated power supply for driving the relays 31 and 32, thereby simplifying the configuration. This arrangement also reduces the costs of the connector and a PDU, which will be described later.

The two electrodes 37 and 38 are electrically coupled to each other through the control plug terminal 13 inside the control jack terminal 23 when the male connector 10 and the female connector 20 mate with each other. To this end, the control plug terminal 13 is made of an electrical conductor. The length of the control plug terminal 13 may be set to such a length that the two electrodes 37 and 38 are coupled to each other through the control plug terminal 13 only after the power supply plug terminals 11 and 12 fully mate with the power-supply jack terminals 21 and 22, respectively. Namely, the two electrodes 37 and 38 are coupled to each other through the control plug terminal 13 only after the entire lengths of the power supply plug terminals 11 and 12 are inserted into the power-supply jack terminals 21 and 22, respectively. To this end, the length of the control plug terminal 13 may be set shorter than the length of the power supply plug terminals 11 and 12.

In this manner, the electrodes 37 and 38 are electrically coupled to each other through the control plug terminal 13. As a result, an electric current from the direct-current power supply 50 flows through the coils 33 and 35 of the respective relays 31 and 32 to close the relay contacts 34 and 36, thereby supplying electric power to the power-supply jack terminals 21 and 22 of the female connector 20. Consequently, electric power is supplied to the information device 40 such as a server through the power supply plug terminals 11 and 12 of the male connector 10.

In the female connector 20 of the present embodiment, the relay contacts 34 and 36 of the respective relays 31 and 32 are electrically connected to the power-supply jack terminals 21 and 22, respectively. The reason why the relay contact is provided for both of the power-supply jack terminals 21 and 22 is that the danger to human body through direct contact is extremely high in the case of a direct current of 200 V or higher. The above-noted arrangement controls the supply of electric power at both of the power-supply jack terminals 21 and 22, thereby further improving safety.

[Configuration of Connector]

Figure 2A:
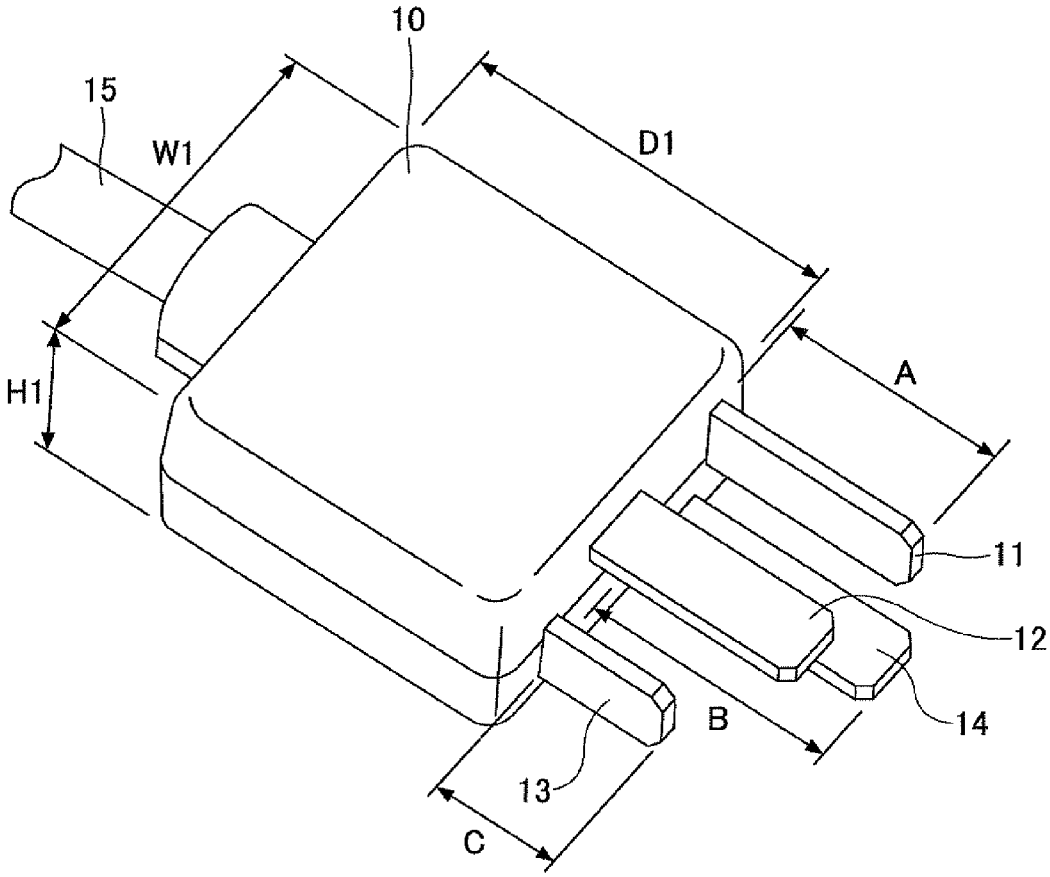
FIGS. 2A and 2B are perspective views of the outer appearances of connectors according to the embodiment.
Figure 2B:
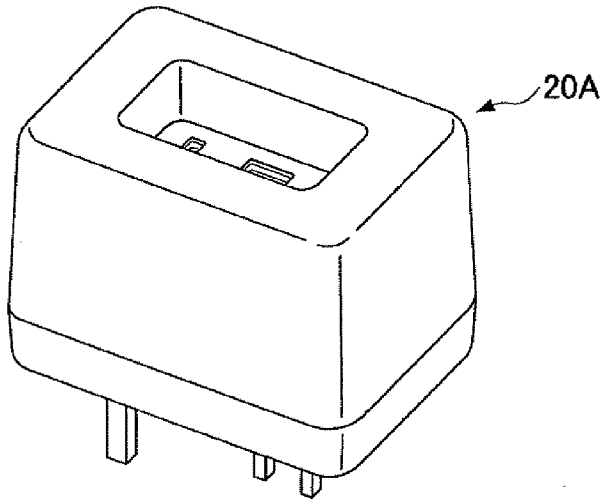

In the following, a description will be given of the configuration of the connectors according to the present embodiment and the method of connection by referring to FIGS. 2A and 2B and FIGS. 3A through 3D. FIG. 2A is a diagrammatic perspective view of the outer appearance of the male connector 10. FIG. 2B is a diagrammatic perspective view of the outer appearance of a female connector socket 20A according to the present embodiment. The female connector socket 20A is a socket portion of the female connector 20 as illustrated in FIG. 1.

Figure 3A:
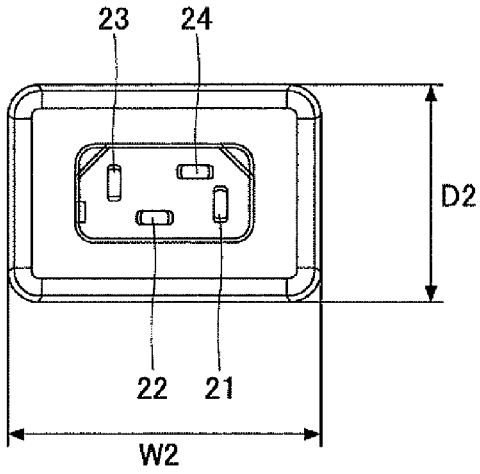
FIGS. 3A through 3D are drawings illustrating the configuration of the female connector according to the embodiment.
Figure 3D:
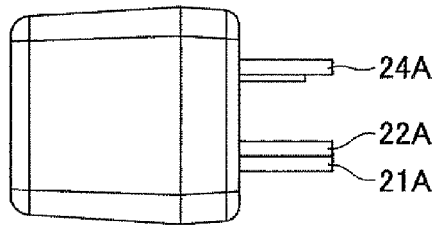
Figure 3B:
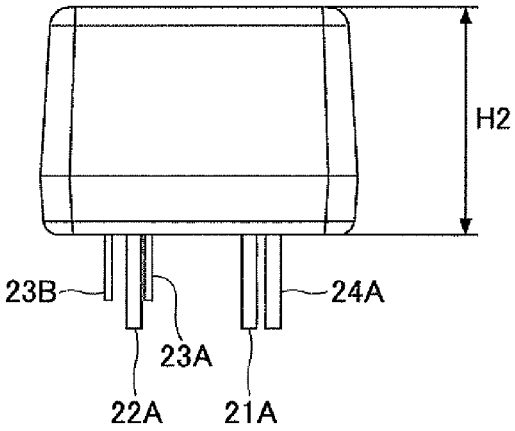
Figure 3C:
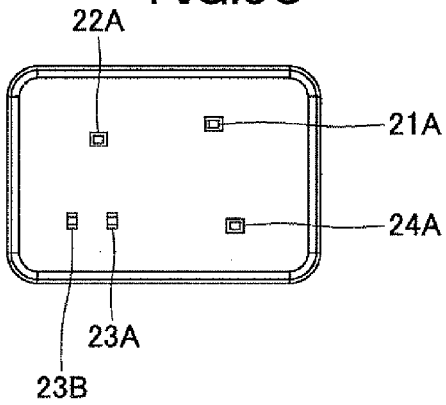

FIG. 3A is a top view of the female connector socket 20A according to the present embodiment. FIG. 3B is a longitudinal side view of the female connector socket 20A according to the present embodiment. FIG. 3C is a rear view of the female connector socket 20A according to the present embodiment. FIG. 3D is a transverse side view of the female connector socket 20A according to the present embodiment.

As illustrated in FIG. 2A, the outer shape of the male connector 10 has a width W1 of 30 mm, a length D1 of 30 mm, and a height H1 of 16 mm. The power supply cable 15 to supply a direct-current voltage of 400 V is connected to the male connector 10. The other side of the male connector 10 has the power supply plug terminals 11 and 12, the control plug terminal 13, and the ground plug terminal 14, which are made of metal. The power supply plug terminals 11 and 12 each have a length A of 17 mm. The ground plug terminal 14 has a length B of 19 mm. The control plug terminal 13 has a length C of 14.5 mm.

As illustrated in FIG. 2B and FIGS. 3A through 3D, the female connector socket 20A of the present embodiment has a structure into which a portion of the male connector 10 is fit. The female connector socket 20A has the power-supply jack terminals 21 and 22 to be connected to the power supply plug terminals 11 and 12, respectively, and also has the ground jack terminal 24 to be connected to the ground plug terminal 14. Further, the female connector socket 20A has the control jack terminal 23 to be connected with the control plug terminal 13, with the electrodes 37 and 38 situated therein.

The female connector socket 20A also has terminals on its rear side, which are for connection to a PDU or the like. Specifically, a power supply terminal 21A, a power supply terminal 22A, a ground terminal 24A, and control terminals 23A and 23B are provided. The power supply terminal 21A is for connecting the power-supply jack terminal 21 to the relay contact 34 of the relay 31. The power supply terminal 22A is for connecting the power-supply jack terminal 22 to the relay contact 36 of the relay 32. The ground terminal 24A is connected to the ground jack terminal 24. The control terminals 23A and 23B are connected to the respective electrodes 37 and 38 of the control jack terminal 23.

As illustrated in FIGS. 3A and 3B, the female connector socket 20A has a width W2 of 56 mm, a length D2 of 40 mm, and a height H2 of 40.5 mm. In the present embodiment, the relays 31 and 32 are situated outside the female connector socket 20A. Alternatively, the relays 31 and 32 may be situated inside the female connector socket 20A.

The electrodes 37 and 38 of the female connector socket 20A do not come in contact with each other when the female connector socket 20A is not connected to the male connector 10. Upon insertion of the control plug terminal 13, the electrodes 37 and 38 come in contact with the control plug terminal 13, so that the electrodes 37 and 38 are electrically coupled to each other through the control plug terminal 13 to allow the passage of electric current.

The length of the control plug terminal 13 may be shorter than the length of the power supply plug terminals 11 and 12. This prevents a high DC voltage of 400 V from being applied to the power-supply jack terminals 21 and 22 before the power supply plug terminals 11 and 12 fully mate with the power-supply jack terminals 21 and 22, respectively. If the high DC voltage of 400 V is applied to the power-supply jack terminals 21 and 22 of the female connector 20 before the male connector 10 is fully inserted into the female connector 20, there is an obvious danger to personnel. The personnel may inadvertently touch the power-supply jack terminals 21 and 22, or may accidentally come in contact with the power-supply jack terminals 21 and 22 through a screw driver, a metal shard, a fragmented wire, or the like.

[Power Supply System]

In the following, a description will be given of the configuration of a power supply system employing the connectors of the present embodiment.

Figure 4:
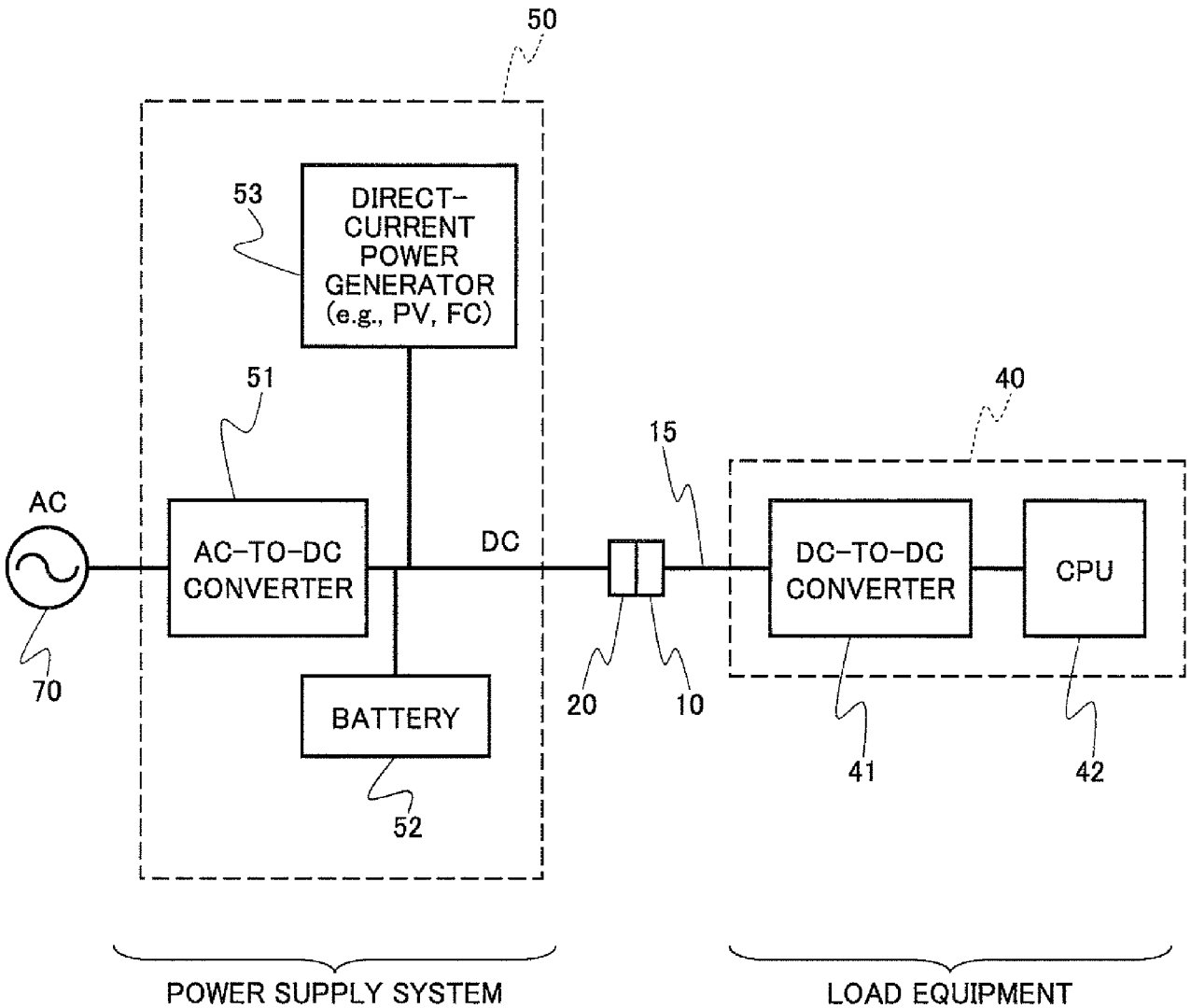
FIG. 4 is a drawing illustrating the configuration of a power supply system employing the connectors of the embodiment.

FIG. 4 is a drawing illustrating the configuration of a power supply system employing the connectors of the present embodiment.

The power supply system supplies an AC electric power from a commercial power supply 70 to the direct-current power supply 50. An AC-to-DC converter 51 of the direct-current power supply 50 converts the AC electric power into a direct-current voltage of 400 V. The direct-current electric power can be stored in a battery or the like. A battery 52 is thus provided as a backup power supply. This makes it possible to cope with a blackout or the like. The female connector 20 of the present embodiment is connected to the direct-current power supply 50 through a power supply cable. The electric power of the 400-V direct-current voltage of the direct-current power supply 50 is supplied through the female connector 20. A direct-current power generator 53 such as a PV (photovoltaic cell) or FC (fuel cell) that does not require power supply from the commercial power supply 70 is provided in the direct-current power supply 50. Voltage conversion may be performed according to need.

The male connector 10 is connected through the power supply cable 15 to the information device such as a server serving as a load. The female connector 20 and the male connector 10 are electrically coupled to each other. With this arrangement, the electric power of the direct-current power supply 50 is supplied to the information device 40 such as a server.

Further, a DC-to-DC converter 41 is provided in the information device 40 such as a server, and converts the 400-V direct-current voltage into a lower DC voltage that is usable by electrical components such as a CPU 42.

Such a power supply system has an advantage in that power loss is small because an AC-to-DC conversion from the commercial power supply 70 is performed only once. Further, there is not much need to pay attention to the thickness of conducting wires or the like in the case of a high direct-current voltage of 400 V. Moreover, a direct-current electric power is storable in the battery 52, which makes it easier to cope with the stoppage of the commercial power supply 70 such as a blackout.

Figure 5:
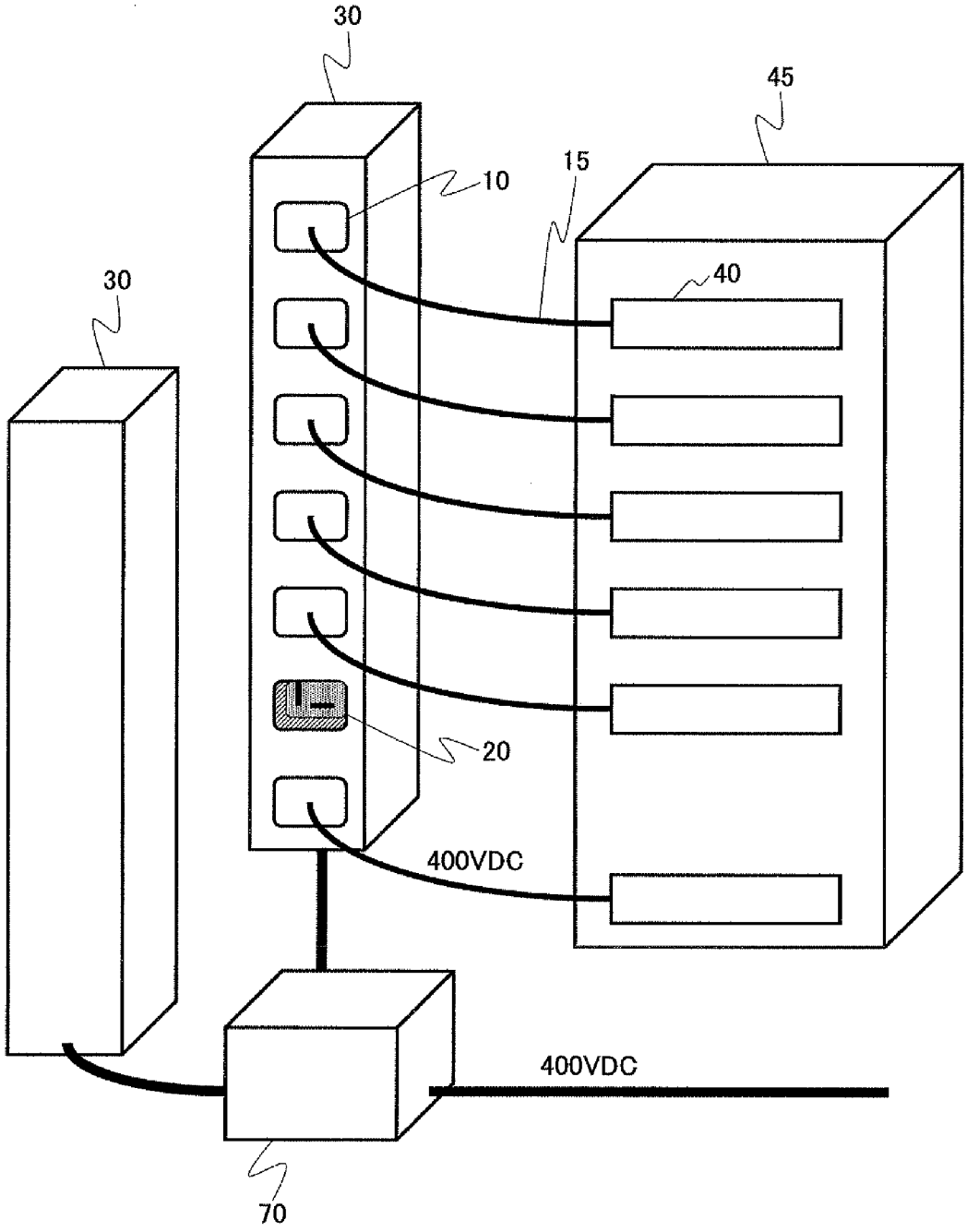
FIG. 5 is a perspective view of a PDU employing the connectors of the embodiment.

In the following, a description will be given of a PDU (i.e., power distribution unit) using the connectors of the present embodiment by referring to FIG. 5.

The 400-V direct-current voltage supplied from the direct-current power supply 50 illustrated in FIG. 4 is applied to a distribution board 70, which distributes electric power to each PDU 30. Each PDU 30 has a plurality of female connectors 20 of the present embodiment, and supplies the electric power of the 400-V direct-current voltage through each of the female connectors 20. A server rack 45 accommodates a plurality of information devices 40 such as servers. The male connector 10 for receiving power supply is connected to each of the information devices 40 such as servers through the power supply cable 15. A male connector 10 is electrically connected to a female connector 20 situated in the PDU 30 to receive the electric power of the 400-V direct-current voltage.

Further, the present invention is not limited to these embodiments, but various variations and modifications may be made without departing from the scope of the present invention.

The present application is based on Japanese patent application No. 2008-288800 filed on Nov. 11, 2008, with the Japanese Patent Office, the entire contents of which are hereby incorporated by reference.

What is claimed is:

1. A female connector for supplying electric power from a power supply to an electric device, comprising:

two power supply terminals to supply the electric power;

two relays connected to the two power supply terminals, respectively, to control supply of the electric power; and two control electrodes configured to control opening and closing of the two relays, wherein the two relays are driven by the power supply, and the two control electrodes are electrically coupled to each other through a control terminal of a male connector upon mating between the female connector and the male connector, the electrical coupling of the two control electrodes causing the two relays to be closed to supply the electric power to the two power supply terminals.

2. The female connector as claimed in claim 1, further comprising a ground terminal.

3. The female connector as claimed in claim 1, wherein the electric power supplied from the power supply is a direct-current voltage.

4. A power supply unit comprising a plurality of connectors, at least one of which is the female connector of claim 1.

5. A pair of connectors, comprising:

a male connector including a control pin and power pins to receive electric power; and a female connector, including:

two power supply sockets configured to mate with the power pins to supply the electric power to the power pins;

two relays connected to the two power supply sockets, respectively, to control supply of the electric power;

a control socket configured to mate with the control pin;

two control electrodes situated in the control socket to control opening and closing of the two relays, wherein the two control electrodes are electrically coupled to each other through the control pin upon mating between the female connector and the male connector, the electrical coupling of the two control electrodes causing the two relays to be closed to supply the electric power to the two power supply sockets.

6. The pair of connectors as claimed in claim 5, wherein the two control electrodes are positioned in the control socket such that the two control electrodes are not electrically coupled through the control pin before the power pins are fully inserted into the power supply sockets, and such that the two control electrodes are electrically coupled through the control pin upon full insertion of the power pins into the power supply sockets.

* * * * *